United States Patent [19]

Tringali et al.

[11] Patent Number: 4,716,840

[45] Date of Patent: Jan. 5, 1988

[54] DRAFTING BOARD WITH REPLACEABLE SURFACE LAYER

[75] Inventors: Richard C. Tringali, Manitowoc; David C. Pflieger, Two Rivers, both of Wis.

[73] Assignee: Hamilton Industries, Two Rivers, Wis.

[21] Appl. No.: 6,387

[22] Filed: Jan. 21, 1987

[51] Int. Cl.[4] ..... A47B 17/00

[52] U.S. Cl. ..... 108/27; 108/90; 52/783

[58] Field of Search ..... 108/27, 90; 312/140.3, 312/140.4; 52/783, 822, 823, 825

[56] References Cited

U.S. PATENT DOCUMENTS

| | | | |
|---|---|---|---|
| 1,207,460 | 12/1916 | Bindel | 52/822 |
| 1,496,581 | 6/1924 | Kusterle | 52/825 |
| 2,228,504 | 1/1941 | Braun | 52/822 |
| 2,251,395 | 8/1941 | Campbell | 52/783 |
| 2,793,090 | 5/1957 | Wolters | 52/783 |
| 2,843,889 | 7/1958 | Keller | 52/822 |
| 2,853,750 | 9/1958 | Davies et al. | 52/823 |
| 2,957,737 | 10/1960 | Irwin et al. | 52/783 |
| 3,389,520 | 6/1968 | Gray et al. | 108/90 |
| 3,554,140 | 1/1971 | Homesberger | 108/90 |
| 4,625,491 | 12/1986 | Gibson | 52/783 |

FOREIGN PATENT DOCUMENTS

| | | | |
|---|---|---|---|
| 3329172 | 2/1985 | Fed. Rep. of Germany | 108/27 |

*Primary Examiner*—Victor N. Sakran

*Attorney, Agent, or Firm*—Tilton, Fallon, Lungmus

[57] ABSTRACT

A drafting board having a planar top surface with a peripheral depression. A thin, resilient, cover sheet is removably secured to the top surface by a pressure-sensitive adhesive and extends into the peripheral depression where it is retained by a peripheral retaining rim extending about the panel below the plane of the working surface. The parts are structurally related so that the cover sheet slopes gradually downwardly into the depression without lifting or bulging along the outer limits of the panel's top surface. Replacement of the cover sheet is achieved by removing the retaining rim, stripping away the old cover sheet, adhesively securing a replacement cover sheet, and securing its border within the depression by re-mounting the retaining rim.

10 Claims, 4 Drawing Figures

DRAFTING BOARD WITH REPLACEABLE SURFACE LAYER

BACKGROUND AND SUMMARY OF THE INVENTION

Drafting boards are frequently provided with a working surface formed by a sheet of vinyl (polyvinyl chloride), that material being selected because of its resilience, toughness, and durability. To insure that the working surface is precisely planar and remains so, such a vinyl sheet is permanently bonded to the planar top surface of the board or panel. Such a construction avoids the possibility of bulges or unevenness that would make the working surface unacceptable for drafting purposes; however, it also renders the covering sheet non-removable should replacement be desired because of damage, discoloration, or wear.

A typical drafting board also includes metal or plastic trim pieces that are applied to the periphery to form a rim or border. Ordinarily, the top surface of the trim is disposed at or below the working surface of the board so that the trim does not interfere with use of that surface in drafting operations. Various means are disclosed in the art for securing trim pieces in place, not only for drafting boards but also for counters, desk tops, and the like. Reference may be had to U.S. Pat. Nos. 2,853,750, 2,228,504, 1,496,581, 2,251,395, 2,957,737, 2,793,090, and 3,389,520 as illustrative of prior art constructions.

Initial efforts to provide a drafting board with a strippable and renewable covering of vinyl or other similar polymeric sheet material, and also with a peripheral rim below the plane of the working surface, have been unsuccessful because conventional pressure-sensitive adhesives are insufficient to prevent lifting or bulging of the covering along the outer limits of the board's top surface in response to forces of extended duration imposed on the cover sheet by the peripheral rim and because of the characteristic stiffness of a material suitable for use as a drafting board cover sheet. While such bulges could be avoided by utilizing an adhesive other than a pressure-sensitive adhesive, such a substitution would also prevent the covering from being easily stripped away when replacement is desired. Accordingly, this invention is concerned with a drafting board construction which utilizes a replaceable cover sheet that maintains a planar working surface, without bulges or other deformations, and yet may be easily stripped away when removal and replacement are desired.

An important aspect of this invention lies in the discovery that if the cover sheet of vinyl, or similar polymeric material having a durometer within the range of about 50 to 90 on the Shore C scale, slopes gradually downwardly from the outer limits of the panel and into a peripheral recess or depression formed in that panel, the edge of the covering sheet may be secured or protected by a suitable retaining rim without weakening and disrupting the adhesive connection between the cover sheet and panel to produce bulges or irregularities in the working surface. Specifically, the cover sheet should slope from the planar top surface of the panel to the inner edge of the retaining rim at an angle no greater than about 45 degrees, preferably within the range of about 15 to 40 degrees. Such a construction allows the use of a cover sheet of sufficient thickness (about 0.015 to 0.045 inches) to provide the resilience and durability needed for drafting board usage.

Briefly, the board takes the form of a rigid rectangular panel having a planar top surface and having a peripheral depression defining an upwardly-facing border surface which extends along a plane spaced below the planar top surface. The resilient polymeric cover sheet, preferably of polyvinyl chloride, of the durometer and thickness indicated above, extends over the top surface and over the border surface and is strippably secured to the top surface by a suitable pressure-sensitive adhesive. A peripheral retaining rim extends about the panel, the rim having planar upper portions extending over the cover sheet within the depression, intermediate side portions extending about the side surfaces of the panel, and bottom portions extending about the outer limits of the panel's underside. Fasteners extend through the bottom portions of the rim and engage the panel for securing the rim in place and for retaining the periphery of the cover sheet within the peripheral depression of the panel. The planar upper portion of the rim and the cover sheet together have a combined thickness substantially less than the distance between the planes of the top surface and border surface of the panel. Also, the planar upper portion of the rim has a width that is substantially less than the width of the depression so that its inner edge is spaced from the outer limits of the panel's planar top surface a distance greater than the distance between the planes of the top and border surfaces. In a preferred embodiment, the fasteners used to hold the retaining rim in place take the form of screws received in threaded openings in the bottom portion of the rim. As the screws are tightened against the undersurface of the panel, the rim is lowered to clamp the periphery of the cover sheet tightly within the panel's peripheral depression.

Other features, objects, and advantages of the invention will become apparent from the specification and drawings.

DRAWINGS

DETAILED DESCRIPTION OF PREFERRED EMBODIMENT

Figure 1:
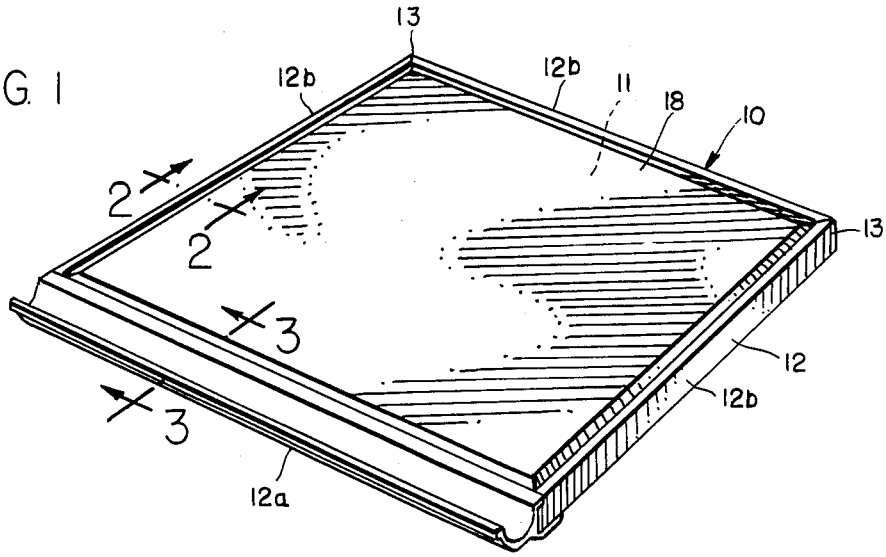
FIG. 1 is a perspective view of a drafting board embodying the present invention.

Referring to the drawings, the numeral 10 generally designates a drafting board embodying the construction of the present invention. The board would ordinarily be one component of a drafting table that would include a base and associated supporting structure for the board. Since such structure is well known, as shown by way of example in co-owned U.S. Pat. Nos. 3,273,517 and 3,638,584, and since the table structure forms no part of the present invention, illustration and further discussion of such supporting structure is believed unnecessary herein.

The board includes a rectangular panel 11 and a perimetric retaining rim 12 extending about the four upstanding side surfaces of the panel. One section of the retaining rim may take the form of a pencil trough **12*a*. The remaining sections 12*b* are identical in cross sectional configuration and may be formed as a single extruded strip which is then notched and bent to form corners 13. It is to be understood that, if desired, pencil trough 12***a* may be omitted and sections 12*b* may be extended about all four sides of the board. While the rim sections 12 and pencil trough 12*a* may be formed of any rigid and durable material, either plastic or metal, extruded aluminum has been found particularly effective. Panel 11 may also be formed of a variety of materials and constructions, either solid or hollow core, all as well known in the art.

Panel 11 has a planar top surface 14 which, when covered, constitutes the working surface of the drawing board. The panel also includes a bottom surface 15 and planar side surfaces 16, the latter being generally perpendicular to the top and bottom surfaces of the panel. Of particular importance is a peripheral depression 17 that extends about top surface 14 and provides an upwardly-facing border surface 17*a* that lies along a plane parallel with, but spaced substantially below, planar top surface 14.

A resilient cover sheet 18 extends over top surface 14 and border surfaces 17*a* and is strippably secured to the top surface by a layer 19 of pressure-sensitive adhesive. The adhesive may be rubber based or may be any of a variety of other synthetic pressure-sensitive adhesive compositions well known in the art. Effective results have been obtained using an acrylic-based pressure-sensitive adhesive marketed under the designation 4914 "Scotch-Grip" brand by 3M, Minneapolis, Minn. but other brands and types of pressure-sensitive adhesives should be suitable.

To provide an effective surfacing material for a drafting board, the cover layer or sheet 18 should be flexible, resilient, tough, and durable. While its thickness may depend in part on the material selected, such thickness should in general fall within the range of about 0.015 to 0.045 inches. A particularly suitable material has been found to be polyvinyl chloride of a thickness falling within that range and, preferably, about 0.030 inches in thickness. Other polymeric sheet materials having similar properties may also be used. Whatever material is selected should have a durometer within the range of about 50 to 90, and preferably 60 to 80, on the Shore C scale so as to provide a surfacing material that is slightly resilient but, at the same time, not too easily deformed by pencil pressure and sufficiently firm to provide a suitable backing for drafting materials. Therefore, while cover sheet 18 is described as being flexible and resilient, its use also requires that it not be limp, soft, or highly deformable in nature.

Figure 2:
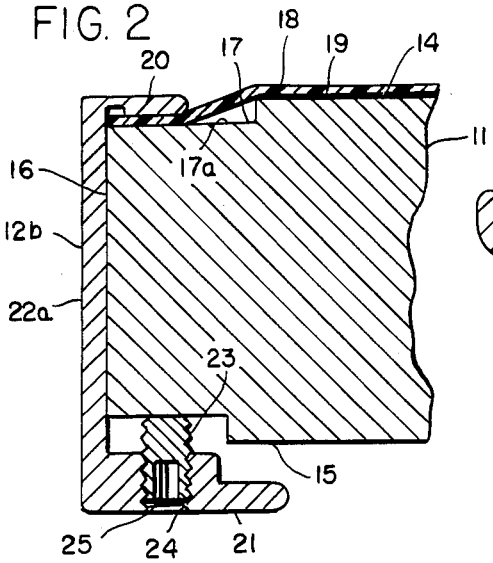
FIG. 2 is an enlarged sectional view taken along line 2—2 of FIG. 1.
Figure 3:
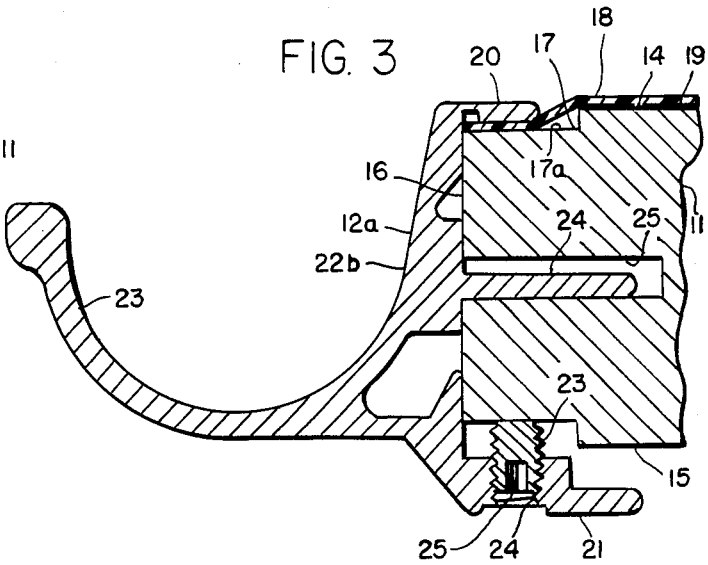
FIG. 3 is an enlarged sectional view taken along line 3—3 of FIG. 1.

The peripheral retaining rim 12 is generally C-shaped in cross section, whether that section is taken through trough portion 12*a* or portion 12*b*. Specifically, the rim includes a planar upper portion or lip 20 that extends over that portion of cover sheet 18 within depression 17, a bottom portion 21 that extends along the bottom surface 15 of the panel adjacent the periphery thereof, and an intermediate side portion 22*a* or 22*b* that extends along side surfaces 16 of the panel 11. In the case of trough section 12*a*, the intermediate side portion 22*b* not only engages the side surface 16 of the panel but also includes an arcuate extension 23 which forms the pencil (or other instrument) supporting trough. Also, to provide greater security of attachment, the intermediate side portion 22*b* may include an inwardly projecting tongue portion 24 received within slot 25 formed in panel 11 (FIG. 3). In the case of rim section 12*b*, the intermediate side portion 22*a* is of simpler construction, consisting simply of a vertical web of uniform thickness as shown most clearly in FIG. 2.

Figure 4:
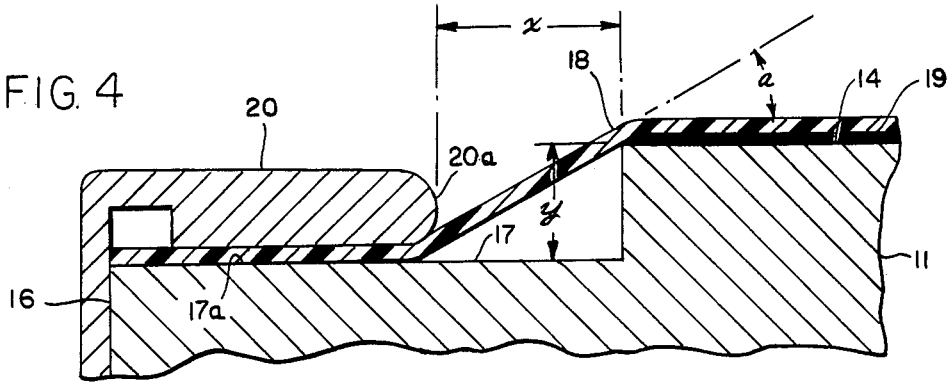
FIG. 4 is a still further enlarged fragmentary sectional view depicting important structural relationships between the various components of the board.

The upper portion or lip 20 of the rim has a rounded inner edge 20*a* (FIG. 4). That rounded edge is spaced from top surface 14 of the panel (or the innermost limits of depression 17) a distance x which is no less than, and preferably substantially greater than, distance y, the latter being the distance between the parallel planes of top surface 14 and border surface 17*a*. Consequently, the angle of slope "a" shown in FIG. 4 is no greater than 45 degrees and is preferably within the range of 15 to 40 degrees. An angle of about 30 degrees, as shown in FIG. 4, is believed particularly effective. If the slope is greater than 45 degrees, that is, if distance y is equal to or greater than distance x, then it has been found that lifting and bulging of the material of the cover sheet 18 occurs along the outer limits of top surface 14. Any such deformations would be highly undesirable and could render the plastic-covered panel unsuitable for use as a drawing board.

The combined thickness of lip 20 and cover sheet 18 should not exceed, and is preferably less than, the depth of depression 17 (distance y). As a result, the top surface of the lip is lower in elevation than the upper surface of that portion of sheet 18 covering working surface 14.

Any suitable means may be provided for securing the rim in place and for retaining the periphery of cover sheet 18 between lip 20 and the border surface 17*a* of panel 11. In the illustration given, screws 23 are received in threaded openings 24 located at spaced intervals along the bottom wall portion of rim 12. Each screw is provided with a socket 25 for receiving a hex wrench. As the screws are tightened and engage the underside of panel 15, lip 20 is drawn downwardly into depression 17 and into tight clamping engagement with the outer periphery of cover sheet 18.

Replacement of the cover sheet may be achieved quickly and easily by simply loosening screws 23 and removing rim 12 to expose the free outer edges of cover sheet 18. Since the portions of the cover sheet extending into depression 17 are not adhesively secured within that depression, they may be easily gripped, lifted, and peeled backwardly to break the adhesive bond between the major central portion of the cover sheet and working surface 14 of the panel. A new cover sheet 18 is then adhesively applied to the working surface 14 of the panel, the rim is refitted, and screws 23 are tightened to retain the peripheral edge portions of the cover sheet within depression 17 and, simultaneously, to lock the rim in place upon panel 11.

In the drawings, panel 11 is shown to provide a space beneath the sloping portion of cover sheet 18 extending from working surface 14 to border surface 17*a*; however, it is to be understood that this space may be occupied by a suitable filler which, preferably, would be an integral portion of panel 11. In such a case, the sloping portion of the cover sheet would rest directly on the sloping surface of the panel.

While in the foregoing, we have disclosed an embodiment of the invention in considerable details for purposes of illustration, it will be understood by those skilled in the art that many of these details may be varied without departing from the spirit and scope of the invention.

We claim:

1. A drafting board comprising a rigid rectangular panel having a planar top surface and having a peripheral depression defining an upwardly-facing border surface extending along a plane spaced below said top surface; said panel also having bottom and side surfaces; a cover sheet extending over said top surface and said border surface and being strippably secured to said top surface by a layer of pressure-sensitive adhesive; said cover sheet being formed of resilient, flexible material having a durometer within the range of 50 to 90 on the Shore C scale; and a peripheral retaining rim extending about said panel; said rim having a planar upper portion extending over said cover sheet within said depression; means extending through said rim and engaging said panel for securing said rim to said panel and for retaining the periphery of said cover sheet within said depression; said planar upper portion of said rim and said cover sheet having a combined thickness substantially less than the distance between the planes of said top surface and said border surface; said planar upper portion of said rim also having a width substantially less than the width of said depression and having an inner edge spaced from the outer limits of said top surface a distance no less than the distance between the planes of said top surface and said border surface.

2. The drafting board of claim 1 in which said cover sheet slopes from the periphery of said top surface to said inner edge of said rim; said slope being no greater than 45 degrees.

3. The drafting board of claim 2 in which said slope falls within the range of 15 to 40 degrees.

4. The drafting board of claim 3 in which said slope is about 30 degrees.

5. The drafting board of claim 1 in which said inner edge of said rim is of rounded cross sectional configuration.

6. The drafting board of claim 1 in which said cover sheet has a durometer within the range of 60 to 80 on the Shore C scale.

7. The drafting board of claim 1 in which said cover sheet has a thickness within the range of about 0.015 to 0.045 inches.

8. The drafting board of claim 7 in which said thickness is about 0.030 inches.

9. The drafting board of claim 8 in which said cover sheet is formed of polyvinyl chloride.

10. A drafting board comprising a rigid rectangular panel having a planar top surface and having a peripheral depression defining an upwardly-facing border surface extending along a plane spaced below said top surface; said panel also having bottom and side surfaces; a resilient cover sheet extending over said top surface and said border surface and being strippably secured to said top surface by a layer of pressure-sensitive adhesive; and a peripheral retaining rim extending about said panel; said rim having a planar upper portion extending over said cover sheet within said depression; means extending through said rim and engaging said panel for securing said rim to said panel and for retaining the periphery of said cover sheet within said depression; said planar upper portion of said rim and said cover sheet having a combined thicknesss substantially less than the distance between the planes of said top surface and said border surface; said planar upper portion of said rim also having a width substantially less than the width of said depression and having an inner edge spaced from the outer limits of said top surface a distance no less than the distance between the planes of said top surface and said border surface; said means for securing said rim to said panel and for retaining the periphery of said cover sheet within said depression comprising a plurality of screws threadedly received within threaded openings in said bottom portion of said rim, said screws having their upper ends engaging the bottom surface of said panel and, when tightened, urging said planar upper portion of said rim into tight clamping engagement with said cover sheet.

* * * * *